US006371894B1

(12) United States Patent
Hill

(10) Patent No.: US 6,371,894 B1
(45) Date of Patent: Apr. 16, 2002

(54) MEDICAL DEVICE FOR PHYSICAL THERAPY TREATMENT

(76) Inventor: Jack Hill, 2522 Blossom St., Columbia, SC (US) 29205

( * ) Notice: Subject to any disclaimer, the term of this patent is extended or adjusted under 35 U.S.C. 154(b) by 0 days.

(21) Appl. No.: 09/507,068

(22) Filed: Feb. 18, 2000

(51) Int. Cl.[7] ..... A63B 21/00

(52) U.S. Cl. ..... 482/121; 482/124; 602/13; 128/845

(58) Field of Search ..... 128/845, DIG. 20; 5/624, 648, 644, 651; 602/13, 24; 482/121, 124

(56) References Cited

U.S. PATENT DOCUMENTS

| | | | | |
|---|---|---|---|---|
| 1,382,531 A | | 6/1921 | Newborn | 5/900.5 |
| 2,953,793 A | | 9/1960 | Rossi | 5/355 |
| 3,009,172 A | | 11/1961 | Eidam | 5/632 |
| 3,118,153 A | | 1/1964 | Hood | 5/655.9 |
| 3,555,582 A | | 1/1971 | Redford | 5/632 |
| 3,639,927 A | | 2/1972 | Munch | 5/91 |
| 3,648,308 A | | 3/1972 | Greenawalt | 5/338 |
| 3,742,528 A | | 7/1973 | Munch | 5/900.5 |
| 3,757,365 A | | 9/1973 | Kretchmer | 5/636 |
| 3,901,228 A | | 8/1975 | Brown | 5/651 |
| 3,939,508 A | | 2/1976 | Hall et al. | 5/740 |
| 4,074,376 A | | 2/1978 | Bond | 5/632 |
| 4,193,150 A | | 3/1980 | Vineberg | 5/431 |
| 4,502,170 A | | 3/1985 | Morrow | 5/632 |
| 4,635,306 A | | 1/1987 | Willey | 5/900.5 |
| 4,935,978 A | | 6/1990 | Luchonok et al. | 5/900.5 |
| D311,470 S | | 10/1990 | Cosgrove, III et al. | D6/601 |
| 5,097,553 A | | 3/1992 | Boland | 5/648 |
| 5,113,875 A | | 5/1992 | Bennett | 5/648 |
| 5,117,517 A | | 6/1992 | Su | 5/900.5 |
| 5,153,960 A | | 10/1992 | Ritter et al. | 5/632 |
| 5,172,439 A | | 12/1992 | Farley | 5/465 |
| D336,134 S | | 6/1993 | Kalatsky | D24/190 |
| 5,222,979 A | * | 6/1993 | Brossard | 128/845 |
| D342,856 S | | 1/1994 | Hogen | 5/632 |
| D360,796 S | | 8/1995 | Goldado | D6/601 |
| 5,476,105 A | * | 12/1995 | Toth | 128/845 |
| 5,479,667 A | | 1/1996 | Nelson et al. | 5/632 |

* cited by examiner

*Primary Examiner*—Jerome W. Donnelly
(74) *Attorney, Agent, or Firm*—Buchanan Ingersoll, P.C.

(57) ABSTRACT

A medical device for physical therapy treatment to enable patients confined to a bed to increase upper and lower extremity strength and promote a quicker return to standing and walking activities. The medical device can be a generally wedge-shaped article constructed of a resiliently compressible material designed to consistently return to its original shape after repeatedly being compressed. The medical device can have an expansive front support base, an expansive, taller rear support base, a generally flat bottom surface, left and right sides and a top surface which slopes from the expansive front support base to the taller rear support base at an angle designed to provide a proper range of motion for a patient's legs when performing a certain therapeutic exercise. The left and right sides can be provided with opposing indentations therein at about the mid portion of the medical device. For stability while performing exercises, the front and rear support bases preferable have expansive surfaces which can be placed between a patient's feet and the footboard of a bed to permit the article to be compressed between the patient's feet and the footboard in order to perform therapeutic exercises. The left and right sides can be compressed either between the patient's thighs or between the outside of the patient's thigh and the side rail of a bed to perform therapeutic exercises. The indentations can be positioned along the sides of the article to provide an anatomically comfortable fit for the patient's thigh and knee.

8 Claims, 4 Drawing Sheets

MEDICAL DEVICE FOR PHYSICAL THERAPY TREATMENT

FIELD OF THE INVENTION

The invention relates to a medical device for physical therapists, particularly for performing upper and lower extremity exercises for the physical rehabilitation of bed-bound patients. More particularly, the invention relates to a generally wedge shaped compressible article for allowing patients to perform exercises while lying down, most likely confined to their hospital bed, which will aid them in increasing upper and lower extremity strength which is essential for returning to standing and walking activities. The medical device is preferably disposable, in that the article should not be shared between patients.

BACKGROUND

In the acute and sub-acute rehabilitation setting, the patients may be very ill and often are confined to a hospital bed. This proves to be a very challenging situation from a therapeutic standpoint and limits a physical therapist to basic bedside exercises. In addition, physical therapists are limited by the amount of time due to the number of patients they see and resources that are available. Lack of time and resources coupled with the poor health of the patients in these settings can leave the patients at great risk for developing secondary complications such as pneumonia, muscle atrophy, decubiti, and osteoporosis due to inactivity or severely decreased activity. This type of situation normally requires that the patient recover from a very tenuous medical state before initiating aggressive physical therapy and typically requires a relatively lengthy period of hospitalization.

Initiating early physical therapy that can be performed in bed by the patient can permit the patient to begin strengthening all of the major upper and lower extremity muscle groups such as shoulder flexors, adductors and abductors; elbow extensors; hip and knee flexors and extensors; hip adductors and abductors; and ankle plantar flexors.

An early rehabilitation regimen can help to speed up the patient's recovery process and allow the patient to progress towards a more advanced exercise regimen when the patient's health is improved to the point where they no longer need to be confined to a bed.

At the present time, a patient in an acute or sub-acute setting may not often be afforded an opportunity to participate in one or more therapeutic exercise sessions on a regular daily basis due to lack of resources or a high patient to therapist ratio.

Physical therapists often work with critically ill patients in intensive care wards as well as the neurosugery and orthopedic wards. Many of these patients are severely ill, having sustained strokes, organ transplants, spinal cord injuries, head injuries, joint replacements and the like. Many of these patients cannot get out of bed for weeks, and in some instances for 2–3 months, without the maximal assistance of two-four healthcare providers. The job of the physical therapist is to find a way to help these patients exercise. In some cases, the patient's exercise consists of the physical therapist moving each limb and joint through a specific range of motion for the patient. Some patients show little or no progress even after weeks of this activity. Moreover, it is physically exhausting work for the patient and for the therapist. In other cases, some patients progress from the point where the therapist moves their limbs to the point where they can perform some resistance exercises to begin strengthening their muscles. However, for the therapist, this can be even more exhausting because the patients require an added resistance, which must be supplied by the therapist, in order to begin to increase muscle mass.

Exercising the upper extremities can be easier for the therapist because surgical tubing, or Theraband™, can be tied to the bed at different angles and patients can exercise most upper body muscles with supervision and minimal assistance from the therapist. However, the lower extremities are another issue. There is no easy way to assist bed-bound patients in strengthening their legs. The only way to assist these patients is by the therapist providing manual resistance. This allows the patient to perform lower body exercises but is inefficient, time consuming, exhausting for the therapist who must serve as the provider of the resistance. Typically, the standard of care is for the therapist to visit these inpatients twice a day. However, because of the large number of patients and the relatively small number of therapists, it can be impossible to provide quality therapeutic time to the sickest of patients, who unfortunately, are the patients that need and would benefit from these sessions the most.

In many instances, patients that require resistance exercises are still critically ill and cannot be moved from bed, except to sit in a chair by their bedside for 10–15 minutes two or three times a day. They still require maximal assistance from healthcare providers to move from their beds to chairs. However, movement and exercise is crucial for these patients. It has been documented that muscle tissue can begin to atrophy in even the healthiest of test subjects after just three days of bed rest. As a result, many such critically ill patients are very unhealthy regarding the deterioration of muscle tissue since they have been confided to bed for weeks or months. Additionally, static positioning for these patients can increase the risk of secondary complications such as infection, blood clots, bed sores, and pneumonia. This is why it is important to apply a means to allow very ill patients to exercise one or more times a day without the need for the direct personal or physical involvement of a therapist at each session.

Some common ways that therapists can provide a source for resistance are not very efficient and are not always popular with the other healthcare providers. Therapists sometimes use extra bed sheets, towels, and blankets to serve as a make-shift lower body gym. Placed under the knees, the patient could extend their knees to strengthen the anterior thigh muscles. Moving the linen around and positioning it properly with regard to the patient can also allow the patient to exercise some different muscle groups, but it often does not allow for quality sessions. For example, the sheets often do not hold up to the weight of the legs and would lose shape very quickly. Also, the nursing and logistics staffs may not appreciate the therapist using extra linen for such purposes because it would require a great deal of extra linen to support the therapeutic exercise efforts of all the patients in a rehabilitation hospital on a daily basis. However, the main deterrent is not the nursing or logistics staffs, but rather the lack of success with using linen material, which is not designed for such a purpose, and its limited availability.

Regarding upper and lower body exercises, some standard exercises are described hereinafter as examples and are not intended to be all inclusive. In regard to the upper body, an elbow extensor strengthening exercise requires the patient to apply pressure against a resistance with bent elbows in an effort to straighten the elbows.

Two common shoulder strengthening exercises are shoulder abductor and adductor exercises. Performing the shoulder abductor exercise requires the application of force or lifting the arm or shoulder away from the body in the frontal plane against a resistance. The shoulder adduction exercise is performed the same as the shoulder abductor, except it requires the application of force or moving the arm across the body. These upper body exercises most often require the therapist to serve as the resistance for the patient to push or move against.

A lower body exercise commonly used to strengthen a patient's hip and knee flexors and extensors involves having the patient bend his knees slightly and then to have some resistance applied to the bottom of his feet. The patient will then attempt to straighten his legs. As indicated above, the physical therapist can simply use her hands to push against the patient's feet in order to provide the resistance, or she may use pillows, sheets, blankets and other articles which can be found on the hospital ward to put between the patient's feet and the footboard for the patient to push against. However, these items, even when the they can be found in sufficient quantities, are not well suited for the task. Furthermore, these items are not designed to be subjected to repeated compression and relaxation and can quickly lose their resiliency, making them ineffective to the point where the therapist has to provide resistance manually.

A common exercise to strengthen a patient's knee extensors requires that the patient lie supine with knees bent and resting on a pillow, roll of blankets, or sheets. To perform the exercise the patient will extend his legs upwards, lift his heels off the bed, and then return his legs back to a bent position with his heels returned to the bed. This will be repeated for a certain number of repetitions.

An exercise for strengthening hip adductors requires an article, whether a pillow or a roll of blankets, to be placed between a patient's thighs wherein the patient performs the exercise by squeezing the article between his thighs and then releasing. This is repeated for a certain number of repetitions. The physical therapist may add resistance to the exercise manually, if desired, by using her hands.

A common exercise to strengthen a patient's hip abductors requires that the patient force his leg, typically one leg at a time, in an outward direction against a resistance. Generally, the therapist may push on an outside portion of the patient's knee or may place a pillow or roll of blankets between the patient's knee and a hospital bed rail.

To strengthen a patient's plantar flexors the therapist may push on the patient's forefoot, or in the alternative, place a bundle of blankets or pillows between the patient's feet and the footboard and have the patient attempt to point his toes towards the end of the bed by moving his foot at the ankle.

In each of the described exercises, the level of resistance can play a very important role in the strengthening of the particular muscle group. The patient performs each exercise while laying in bed in a supine position. The physical therapist may frequently have to provide resistance manually because items like pillows and rolled up blankets or sheets can quickly lose their ability to provide even a minimal amount of resistance during the repeated cycles of compression and relaxation required by the therapeutic exercises. The use of manual resistance, besides being physically tiring, also requires the therapist to spend a larger amount of time with each patient. As a result, a patient is always not afforded an opportunity to participate in frequent therapeutic exercise sessions on a regular daily basis which is critical if strength gains are to be achieved by the patient in this medical setting.

Therefore, there is a need for a suitably designed medical device which can, under the guidance of physical therapist, permit a patient to perform a number of therapeutic exercises on a regular basis many times a day while the patient is confined to bed. The patient would be able to privately perform the therapeutic exercises without requiring the personal attention of a physical therapist at every session. Regular and consistent performance of these exercises, made possible by such a medical device, can provide muscle strengthening and early weight bearing type exercises which could possibly enable a patient to more quickly regain the ability to stand and walk. Furthermore, such a medical device could standardize the manner in which exercises are performed in the medical setting. The therapist would no longer have to rely on extra pillows and blankets in the hospital ward and the therapist would also not be required to exert manual resistance with each patient. Such a device can help the therapist to treat more patients on a daily basis more effectively.

U.S. Pat. No. 3,009,172 to Eidam, U.S. Pat. No. 3,555,582 to Radford, U.S. Pat. No. 4,502,170 to Morrow, U.S. Pat. No. 5,479,667 to Nelson et al., U.S. Pat. No. 3,648,308 to Greenwalt, and U.S. Pat. No. 4,913,150 to Vineberg all disclose and describe generally wedge shaped articles for supporting the head and other portions of the upper body of an individual. Eidam describes a "head suspending pillow" having a "pillow body 4" with a "shoulder supporting portion 6 which might be generally determined from its lower end portion 8 to a portion transversely of the line 10, which line is a vertical line on the side of the pillow between the head and shoulder portions." The "head portion 14" can be provided with a "recess 16" which is U-shaped and can extend from the top to the bottom of the pillow. Eidam also states that "the lower portion of the taper or the shoulder-supporting portion 6 may be brought to a sharper edge at 8 if desired, but the principal object of the pillow is to provide a shoulder supporting portion 6 which will relieve a great deal of the body weight in a head supporting portion 14 with its recess 16, the latter providing for minimum contact between the head supporting portion and the head of the sleeper.

Similarly, Radford also discloses a wedge shaped article described as a "therapeutic device" having generally flat support surfaces 6 and 8, respectively in upper surface 20 which intersects the bottom 6 and back 8 surfaces, to form upper and front edges 14 and 16, respectively. The therapeutic device is also described as having a "sinuously curved upper surface 20" which has "a plurality of alternatively disposed convex 15 and 17 and concave 19, 21 portions which merge smoothly with one another to form a continuous surface and which are angularly disposed with respect to one another being adapted to position certain portions of the users head, neck and back in predetermined relation with respect to one another when the support is resting either on the bottom surface 6 or the back surface 8. Moreover, Radford states that "when the device 2 is resting on the bottom surface 6, the concave portions 19 and 21 are adapted to receive the posterior occupit and posterior mid-dorsum of the user whereas, when the device is resting on the back surface 8, the concave portions 19 and 21 are adapted to receive and properly posterior mid-sacrum and posterior mid-dorsum respectively."

Morrow describes a "physiologic support system and method" and describes a "method for improving posture and relieving lower back pain including the steps of pressure a convex pillow against the region of the ilia, sacrum and fifth lumbar vertebrae to produce a substantially sacral base angle and fully oppose any movement tending to cause rotational shifting of the pelvis, and supporting the thighs and calves in an elevated position such that the thigh extend upwardly at an angle of from about 53° to 63° from horizontal and the calves extend of an angle of from about 0° to 20° downwardly from horizontal." Morrow discloses that the "calve support 12*b*" is angled with respect to"thigh supporting surface 12*a*" such that the leg muscles "exert forces on the pelvis P which are consistent with and supportive of the forces which are being exerted by pelvic support pillow 10."

Nelson et al. discloses a "ergonomic pillow assembly" which is described as having "a head support assembly 36" with a "thoracic support section 38" and a "lumbar support assembly 39." Similarly to Eidam and Radford, Nelson et al. discloses a wedge shaped device which tapers to a relatively thin front edge, which is consistent with its intended use of supporting comfortably the head, neck and upper torso of a person who is lying on the pillow.

Greenawalt and Vineberg both disclose wedge shaped compressible articles for supporting the head, neck and thorax of a person. Greenawalt additionally discloses a raised member on the sloping surface which can act as a cervical spine support. Two United States Design Patents, Pat. Nos. Des. 334,134 to Kalatsky and Des. 360,796 to Golado, also disclose generally wedge shaped articles made of a compressible material.

In regard to all of the devices showing generally wedge shaped pillows or therapeutic devices, particularly Eidam, Radford, Morrow and Nelson et al., each of those articles tapers to a relatively narrow front edge, in contrast to the "generally" wedge-shaped medical device according to the invention. However, that feature is consistent with the intended purpose of each of those articles, which is to generally support the head and upper torso portions of a person who lies down on top of the medical device with their head, neck and perhaps portions of their upper torso, positioned on top of the article. If there were more than a narrow front edge provided on each of those articles, the article would be uncomfortable to lie on, thus defeating the intended purpose of the article. Unlike these devices, the generally wedge-shaped device which will be described in more detail hereinafter, is designed not to support the neck or upper body of a person who lies on the medical device, but rather to be used as a resiliently compressible article for performing therapeutic upper and lower body exercises. Generally, these therapeutic upper and lower body exercises involve a patient using their arms, legs and feet to compress the resilient article against a rigid surface, such as the foot board or side rails of a bed or against a wall.

U.S. Pat. No. 3,648,308 to Greenawalt and U.S. Pat. No. 4,193,150 to Vineberg both disclose wedge shaped compressible articles for supporting the head, neck and thorax of a person. Additionally, Greenawalt discloses a raised member on the sloping surface which can act as a cervical spine support. United States Design Pat. No. Des. 336,134 to Kalatsky and Des. 360,796 to Goldado, also disclose wedge shaped articles made of a compressible material. Kalatsky shows a wedge shaped ornamental design for an orthopedic back cushion. Goldado discloses a wedge shaped ornamental design having a detachable foot rest portion. Kalatsky and Goldado do not provide either a rear support base or a front support base and also are not designed to be repeatedly compressed and relaxed to perform therapeutic exercises.

Therefore, in view of the lack of any articles designed to meet the needs of physical therapists for treating patients who are confined to a bed, it would be very desirable to provide a compressible wedge shaped medical device, and method for using such, which has front and rear support surfaces and side support surfaces. Such a medical device can be used by patients confined to a bed for performing exercises which can strengthen all major upper and lower extremity muscle groups. In this manner, an early aggressive physical therapy regimen can be initiated which can decrease recovery time by increasing upper and lower extremity strength which is essential for an earlier return to out of bed activities such as standing and walking.

SUMMARY

A wedge shaped medical device is provided which can be used by physical therapist to treat patients who are confined to a bed. Such a medical device having features of the present invention can include a generally wedge shaped article constructed of a compressible material having an expansive front support base, an expansive rear support base taller than the front support base, a generally flat bottom surface, left and right side surfaces, and a top surface which slopes upward from the front support base to the rear support base. The front and rear support bases, and particularly the front because that is the surface which the patient must push against with his feet, can preferably have a length and width forming a surface expansive enough to provide stable surfaces for compressing the medical device against a flat surface, such as the footboard of a bed or a wall. Additionally, the dimensions of the medical device can be chosen such that the sloping upper surface can have an angle designed to provide a proper range of movement for a therapeutic exercise. Further alternative features of the medical device can include a pair of opposed indentations in the sides surfaces of the device. The indentations can be positioned at a location along the sides of the device chosen to provide an anatomically comfortable fit for the patient's thigh and knee joints.

The medical device can be designed to permit the patient to perform exercises which can strengthen all of the major upper and lower extremity muscle groups while he is lying in a hospital bed in a supine position. Almost without exception, hospital beds have side rails and a footboard, each of which can be used as a barrier to abut the support surfaces of the medical device. However, if for some reason the hospital bed did not have side rails, or a footboard, or if the patient were confined to a bed in the patients home which did not have side rails or a footboard, the patient could be assisted in lying in a supine position on the floor, preferably on a mat, next to a wall with the medical device abutting the wall to perform the exercises.

The medical device can preferably be formed of a disposable, hypoallergenic, and flame retardant resilient material, such as foam, for health and safety reasons. Each patient could receive one such medical device for his or her personal use only. The medical device can result in benefits for the patient, the medical staff and the hospital in general. The medical device can provide a patient who is confined to a bed with a means for performing many therapeutic muscle strengthening and early weight bearing type exercises which are key components of transfer training or teaching patients to move from one position to another position. For example, the medical device can be used to perform a type of exercise commonly known as a leg press which is a component of sit-to-stand transfers. Another exercise the medical device can be used to perform is known as hip adduction and is important for rolling in bed and supine-to-sidelying-to-sit transfers.

Allowing a patient to participate in many exercise sessions each day on a regular daily basis can provide the intensity that is needed to promote this necessary strengthening and may assist in decreasing hospitalization time. Shorter hospitalization can lead to decreased charges to the patient and his or her insurance company. The use of such a medical device can also standardize how these exercises are performed in the medical setting. Currently, physical therapists most often use whatever can be found in the hospital ward to assist them with the exercises. The therapists often have to rely on pillows, blankets, and other items that are not always available. Often they must provide manual resistance with their own hands because of the unsuitability of such items for use in exercises requiring repeated compression and relaxation of the item. Using manual resistance is also both tiring and time consuming. Use of equipment like the present medical device can allow a therapist to work with many more patients because standardized exercises can be performed by the patient either without any supervision at all, or under supervision that could be provided by any medical staff member. Additionally, if patients are able to recover more quickly with assistance of such a medical device, hospitalization time can be shortened and the cost of providing medical care can be reduced.

BRIEF DESCRIPTION OF THE DRAWING FIGURES

DETAILED DESCRIPTION OF CERTAIN EMBODIMENTS

Figure 1:
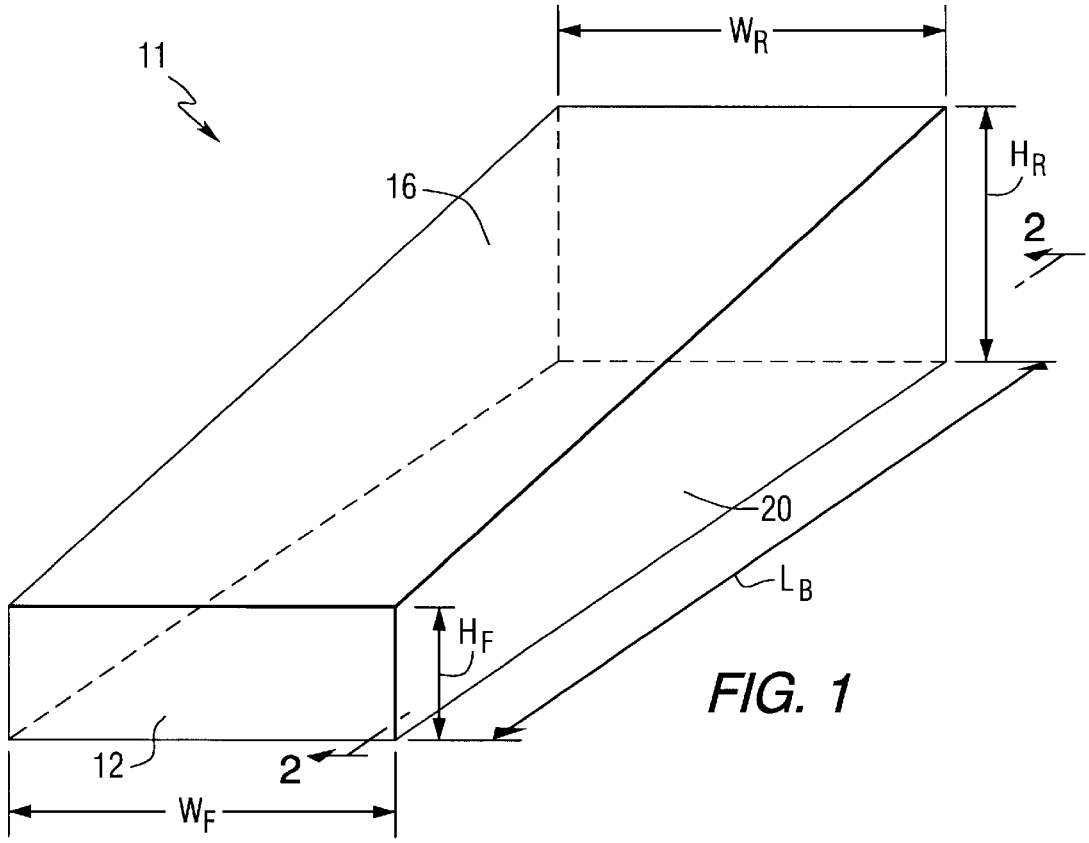
FIG. 1 is a perspective view of an embodiment of the present invention.
Figure 2:
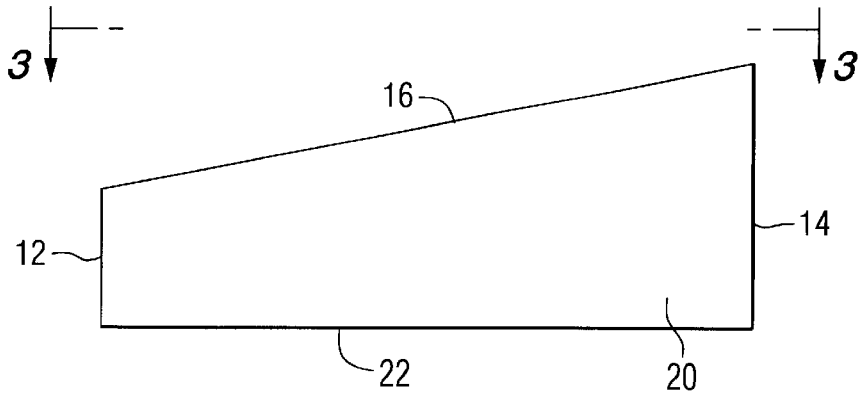
FIG. 2 is a side plan view of FIG. 1.
Figure 3:
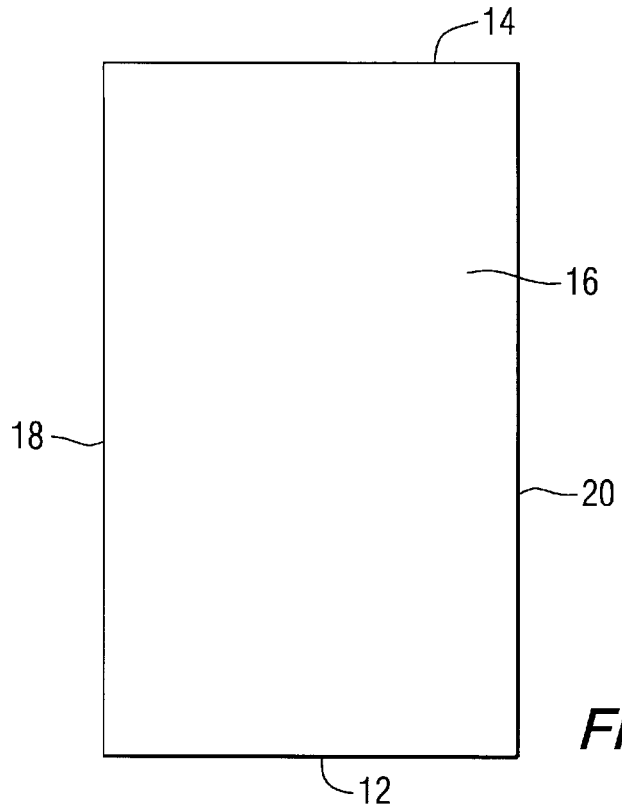
FIG. 3 is a top plan view of FIG. 2.

Referring now to the drawing figures, wherein like elements are numbered the same in the several figures, FIGS. 1 through 3 illustrate one embodiment of the medical device comprising a generally wedge shaped resilient article 11 having an expansive, generally flat front support base 12 and an upwardly sloping top surface 16. FIGS. 2 and 3 show the expansive, generally flat rear support base 14 being generally parallel to the front support base 12 to provide stability when the front support base 12 is compressed toward the rear support base 14 to perform a therapeutic exercise, wherein the rear support surface 14 is abutted against the footboard of a bed (not shown). The expansive front support base must be large enough to accommodate both feet of a patient in a stable manner. Similarly, since some of the therapeutic exercises are performed by compressing the resilient article 11 against a flat surface, the rear support base must also be sufficiently expansive so that the resilient article 11 is held stable when the patient pushes against the expansive front support base to perform an exercise. The generally wedge shaped resilient article 11 further has a generally flat bottom surface 22 and generally flat, parallel left and right side surfaces 18 and 20, respectively. The resilient article 11 can have appropriate overall dimensions to facilitate use of the resilient article 11 by a patient who is confined to a hospital bed. For example, the expansive front support base 12 can have a height, $H_F$ of six inches and the rear support surface can have a height, $H_R$, of twelve inches. The length, LB, of the base of the resilient article 11 can be about thirty inches and the width of both the front support surface 12 and the rear support surface 14, $W_F$ and $W_R$, respectively, can be about eighteen inches.

The dimensions of the medical device/resilient article 11 set forth above can vary, but are determined with consideration given to the angle of the sloping top surface 16. The slope of the top surface 16 is preferably designed to provide an angle of inclination to provide an appropriate range of motion for a patient's legs when performing certain therapeutic exercises with the resilient article 11. The particular exercises which involve the sloping upper surface will be recognized as the various types of exercises which can be performed with the resilient article 11 are described in more detail hereinafter.

Figure 4:
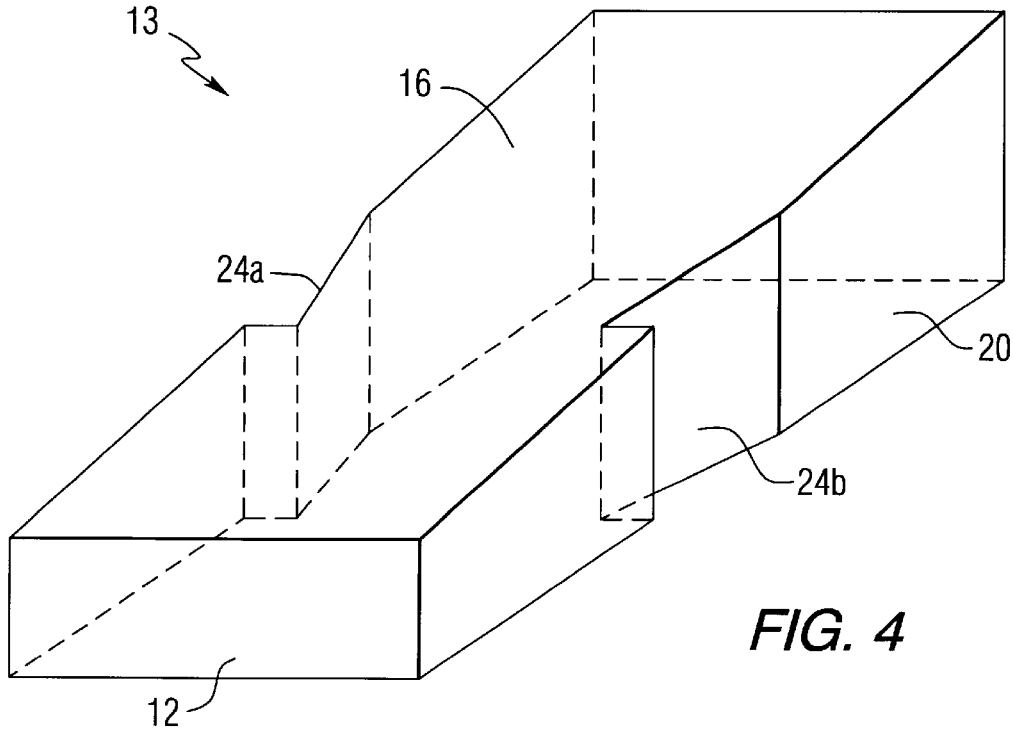
FIG. 4 is a perspective view of an alternative embodiment of the present invention.

An alternative embodiment of the medical device is illustrated in FIG. 4. This generally wedge resilient shaped article 13 can be identical to the resilient article 11 shown in FIG. 3 except for the triangular notch shaped indentations 24*a* and 24*b* in respective left 18 and right 20 side surfaces.

Figure 5:
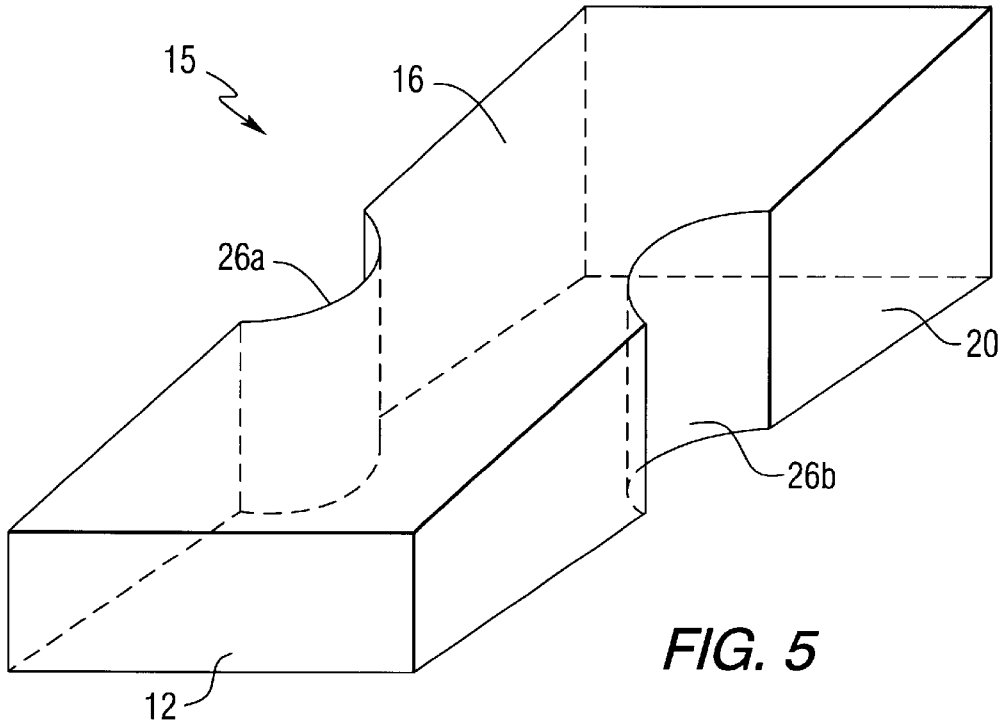
FIG. 5 is a perspective view of another alternative embodiment of the present invention.

A similar alternative embodiment shown in FIG. 5, the resilient article 15 can be identical to the resilient article 11 shown in FIG. 3 except for the semi-circle shaped indentations 26*a* and 26*b* in respective left 18 and right 20 side surfaces.

In each case, the resilient, generally wedge shaped article 11, 13, and 15, preferably can be formed from a hypoallergenic, flame retardant, medical grade polyurethane foam material. Additionally, the resilient article should be disposable in order to reduce the possibility of spreading infections among patients. Each patient would receive his own personal article which he may keep. The resiliently compressible material should be designed to return to an uncompressed state after repeated compressions over a long period of time.

Each of the embodiments of the resilient article 11 can be produced in a variety of different levels of stiffness. Additionally, each level of stiffness can have a different color associated with the particular stiffness. Patients would initiate the regimen with a lower stiffness and as strength improved, increasing levels of stiffness could be provided. The associated colors permit immediate visual identification of what level of stiffness is being used by the patient. Moreover, the different colors and levels of stiffness allow for goal-setting by the therapist as well as visual indication of improvement as a patient progresses from one color and stiffness to another.

Figure 6:
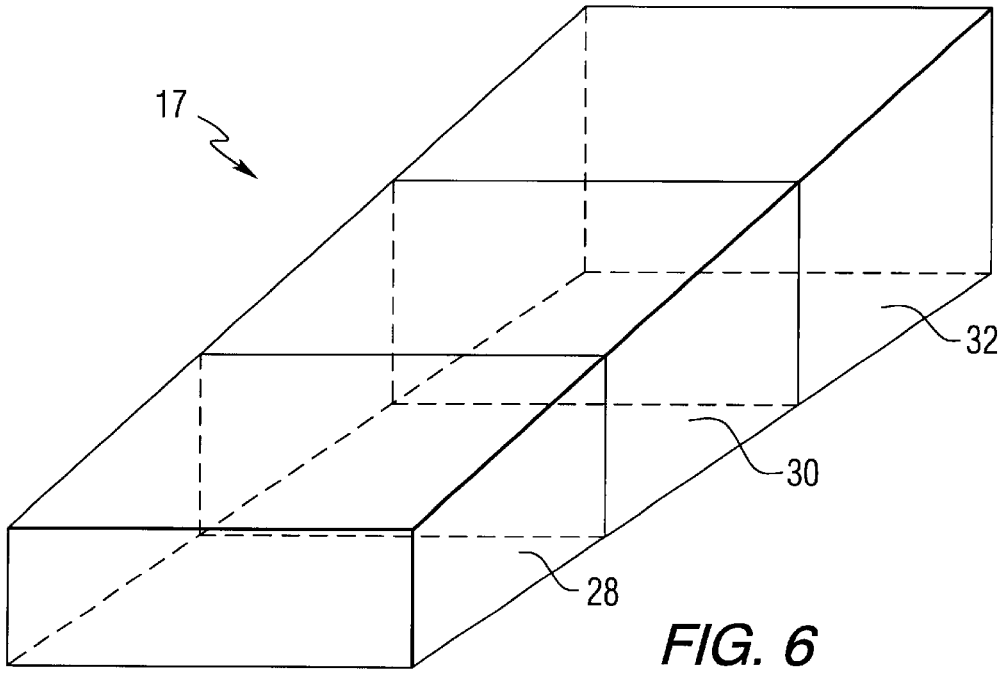
FIG. 6 is a perspective view of an embodiment of the present invention having multiple layers of stiffness.
Figure 7:
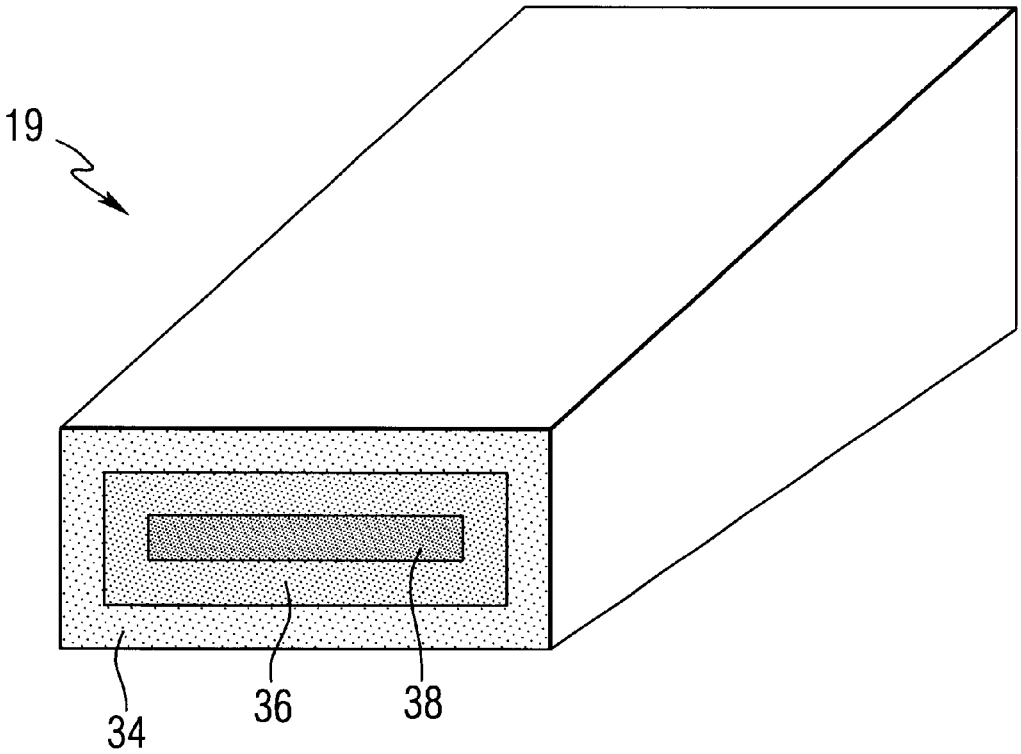
FIG. 7 is a perspective view of an alternative embodiment of the embodiment shown in FIG. 6 having multiple layers of stiffness.

In another alternative embodiment, the resilient article 17 can be comprised of multiple layers of resiliently compressible material, as shown in FIG. 6. Preferably, the first layer 28 is of a lower stiffness than the second layer 30, with the last layer 32 being the stiffest. In this manner the resilient article 17 could be effectively utilized by a number of different patients regardless of the individual strength of each patient. A stronger patient could compress the resilient article 17 more, but a weaker patient could still effectively use the resilient article 17 because of the softer first layer 28. Likewise, as a patient becomes stronger, the resilient article 17 will not lose its effectiveness since the variable resistance provided by the three layers 28, 30, and 32 would continue to provide increasing resistance. The layering preferably progresses linearly from the front base support to the rear base support. As such, the mid section, layer 30, preferably should be designed such that if indentations are provided in the sides, the indentations are within a single layer of uniform stiffness. An alternative embodiment of a resilient article 19 similar to that shown in FIG. 6 is illustrated in FIG. 7. The resilient article 19 is designed to provide increasing resistance when it is compressed from the left 18 and right 20 sides as well as when compressed from the front support base 12 to the rear support base 14. In this embodiment, the resilient article 19 can be formed such that the foam material increases in stiffness from the outside towards the center. An outer layer of material 34 is less stiff than the next adjacent layer 36, with the innermost layer 38 forming an even stiffer core portion.

The following description sets forth a more detailed explanation of how a resilient, generally wedge-shaped article according to the invention can be utilized to perform various upper and lower body exercises. The shoulder adduction exercise is commonly known as "pectoral flys." To perform the exercise the resilient article can be placed between the patients' elbows and arms and the device is squeezed in an attempt to move the elbows together. This exercise works the pectoralis major, teres major, and latissimus dorsi muscles.

To perform the shoulder abduction exercise, the resilient article can be placed between the patient and the side rails of a bed. The patient, while laying supine, attempts to move his shoulder, elbow and arm away from him and against the resilient article in the coronal plane, thus working the middle deltoids and supraspinatus muscles.

To perform the shoulder flexion exercise, the resilient article can be placed between the patient and the side rails of the bed. The shoulder, elbow and arm of the patient are moved away from him, in the sagittal plane, against the resistance provided by the resiliently compressible article. This exercise works the anterior deltoid and pectoralis major muscles.

To perform the elbow extensor exercise, the article can be placed with the high end directly behind the patient. The patient places her hands on the wedge and presses directly down in an effort to strengthen his elbows. This exercise works the triceps, brachii and pectoralis minor muscles.

To strengthen a patient's hip and knee flexors and extensors, the resilient article can be placed in the patient bed with the foot support base at the patient's feet and the taller rear support base abutting the footboard of the bed. With the patient's legs slightly bent and his feet against the front base support the patient will compress the resilient article between his feet and the footboard. This activity is commonly known as a leg press and simulates early standing activity and also simulates sit-to-stand transfers for patients otherwise unable to perform this task.

To strengthen a patient's knee extensors, the resilient article can be turned 180 degrees so that the rear support base is towards the patient's posterior. The patient's legs would be lifted up and placed over the medical device so that the rear support base rests under his knees. To perform the exercise the patient attempts to straighten his leg by lifting his heel off the sloping surface while maintaining contact between the tall end of the resilient article and the back of his knee. This exercise is commonly known as a leg extension. The angle of inclination of the sloping upper resilient article is important for the proper performance of this particular exercise.

To strengthen a patient's hip adductor muscles, the resilient article is placed between the patient's thighs. Where indentations are provided on the resilient article, the indentations will be located so that the patient's inner thigh, or knee joint, will rest in the indentation. The patient then squeezes his knees towards each other thereby compressing the resilient article between his thighs.

To strengthen the hip abductor muscles, the resilient article is placed between the patient's thigh, or knee, and the bed side rails. Where indentations are provided on the medical device the patient's thigh near the knee joint will rest in the indentation. To perform this exercise the patient will attempt to compress the resilient article between the outside of his thigh and the bed side rail. This exercise is performed individually with each leg.

To strengthen a patient's plantar flexor muscles, the resilient article is positioned as for strengthening of the hip and knee flexors and extensors. However, in this exercise, instead of the patient's straightening his leg, he will only try to point his toes towards the footboard to compress the resilient article. This exercise is commonly known as a toe, or calf, press.

A resilient article according to the invention can allow a patient to exercise muscle groups safely and efficiently several times a day. Since the resilient article could be involved in patient care, it should be hypoallergenic and must be produced from a material that can return to its original shape each time after being repeatedly deformed. Different levels of thickness can provide varying levels of resistance and different colors that correspond to the resistance can allow the therapist and patient to develop short and long term therapy goals. This can also allow for the documentation of strength gains over time that the patient attains. Different resilient articles of different compressive value can allow therapists to quickly inform physicians on the progress of their patients. A therapist will be able to say that a patient moved up from "article A" to "article B" because of gains in strength. This would allow for easy communication between physicians and therapists, it would serve as a motivator for the patient because they would see visible proof that they are getting stronger, and it would assist healthcare organizations with reimbursement because they would have documentable improvement. Most importantly, it would allow patients the opportunity to exercise without requiring the presence of therapists several times a day. Any provider or family member, with the assistance of a set of simple instructions; and some advice from the therapist, would be able to place the resilient article in different positions that would allow the patient the opportunity to exercise all of the major upper and lower body muscles groups.

While certain specific embodiments have been described in detail, it will be appreciated by those skilled in the art that various modifications and alternatives to those details could be developed in light of the overall teachings of the disclosure. Accordingly, the particular embodiments disclosed herein are intended to be illustrative only and not limiting to the scope of the invention which should be awarded the full breadth of the following claims and any and all embodiments thereof.

I claim:

1. A medical device for physical therapy treatment to enable patients confined to a bed to increase upper and lower extremity strength and promote a quicker return to standing and walking activities, said device comprising:

a generally wedge shaped resiliently compressible article compactly sized for use in a bed by a patient to perform physical therapy exercises;

said article having an expansive front support base, a generally flat bottom surface, an expansive rear support base, a sloping top surface, a left side, and a right side;

said expansive front support base extending perpendicular from said bottom surface and sized to provide a stable pushing surface for a patient's feet;

said expansive rear support base extending perpendicular from said bottom surface and taller than said expansive front support base and sized to provide a stable surface against an abutment when said expansive front surface is compressed toward said rear surface to perform a therapeutic exercise;

said top surface sloping upward from said expansive front support base to said expansive rear support base and having an angle of inclination designed to provide a proper range of motion for said patient's legs when performing a therapeutic exercise using said article;

wherein said resiliently compressible article is formed in a plurality of layers of increasing stiffness;

each subsequent layer of said plurality of layers requiring more strength to compress than a preceding layer when force is applied to said article by a patient performing a therapeutic exercise;

said increasing stiffness allowing said article to continue to be effectively utilized as a patient becomes stronger; and said increasing stiffness further allowing said article to be effectively utilized by patients of varying strength.

2. The medical device of claim 1 wherein each layer of said plurality of layers of increasing stiffness is generally parallel to each other layer of said plurality of layers and each said layer increases in stiffness from said expansive front support base toward said expansive rear support base.

3. The medical device of claim 1 wherein each layer of said plurality of layers of increasing stiffness is encompassed by an adjacent one of said layers and said stiffness increases from an outer most layer toward an innermost layer of said article.

4. The medical device of claim 3 wherein said left and right sides are generally parallel to each other and generally perpendicular to said bottom surface.

5. The medical device of claim 4 wherein said front expansive support base is about 6 inches tall, said expansive rear support base is about 12 inches tall, each of said expansive front and said rear support bases are about 18 inches wide, and said bottom surface is about 30 inches long whereby said angle of inclination is defined by said dimensions.

6. A medical device for physical therapy treatment to enable patients confined to a bed to increase upper and lower extremity strength and promote a quicker return to standing and walking activities, said device comprising:

a generally wedge shaped resiliently compressible article compactly sized for use in a bed by a patient to perform physical therapy exercises;

said article having an expansive front support base, a generally flat bottom surface, an expansive rear support base, a sloping top surface, a left side, and a right side;

said expansive front support base extending perpendicular from said bottom surface and sized to provide a stable pushing surface for a patient's feet;

said expansive rear support base extending perpendicular from said bottom surface and taller than said expansive front support base and sized to provide a stable surface against an abutment when said expansive front surface is compressed toward said rear surface to perform a therapeutic exercise;

said top surface sloping upward from said expansive front support base to said expansive rear support base and having an angle of inclination designed to provide a proper range of motion for said patient's legs when performing a therapeutic exercise using said article;

said left and right sides providing compressible surfaces for a patient's thigh to push against during a therapeutic exercise;

said left side having a left indentation approximately midway between said expansive front and rear support bases;

said left indentation providing an anatomically comfortable fit and a stable pushing surface for a patient's thigh when performing a therapeutic exercise;

said right surface having a right indentation therein opposite said left indentation; and said right indentation also providing an anatomically comfortable fit and a stable pushing surface for a patient's thigh.

7. The medical device of claim 6 wherein said left and right indentations are triangular shaped notches.

8. The medical device of claim 1 wherein said left and right indentations are semi-circular shaped notches.

* * * * *